US007112035B2

(12) United States Patent
Fees et al.

(10) Patent No.: US 7,112,035 B2
(45) Date of Patent: Sep. 26, 2006

(54) DELIVERY SYSTEM

(75) Inventors: Hans-Joerg Fees, Bietigheim-Bissingen (DE); Reinhard Dittmann, Feldkirchen (DE); Christoph Mittermueller, Munich (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/047,554

(22) Filed: Feb. 2, 2005

(65) Prior Publication Data

US 2005/0169781 A1 Aug. 4, 2005

(30) Foreign Application Priority Data

Feb. 3, 2004 (DE) ..... 10 2004 005 224

(51) Int. Cl.
*F04D 5/00* (2006.01)

(52) U.S. Cl. ..... 415/55.1; 415/171.1

(58) Field of Classification Search ..... 415/55.1, 415/55.2, 55.3, 55.4, 55.5, 55.6, 55.7, 171.1, 415/174.5, 221, 224; 416/185
See application file for complete search history.

(56) References Cited

U.S. PATENT DOCUMENTS 3,907,456 A 9/1975 Krienke
4,492,515 A * 1/1985 Watanabe et al. ..... 415/55.5
4,586,877 A 5/1986 Watanabe et al.
4,854,830 A * 8/1989 Kozawa et al. ..... 417/365
5,137,418 A 8/1992 Sieghartner
6,210,102 B1 * 4/2001 Yu et al. ..... 415/55.1
6,299,406 B1 * 10/2001 Yu et al. ..... 415/55.1
6,551,058 B1 * 4/2003 Nowack ..... 415/140

FOREIGN PATENT DOCUMENTS

DE 42 43 544 A1 6/1994
DE 44 15 566 A1 11/1995

* cited by examiner

*Primary Examiner*—Edward K. Look
*Assistant Examiner*—Nathan Wiehe
(74) *Attorney, Agent, or Firm*—Ronald E. Greigg

(57) ABSTRACT

In known delivery systems, a pump chamber and a revolving impeller in the pump chamber rotating about a pump axis, in which protuberances are provided inside the pump chamber on predetermined end walls, it is disadvantageous that the protuberances very and are complicated to make. In the delivery system of the invention, the friction in the pump chamber is reduced and the efficiency is improved by providing spacers, which space the impeller apart from the end walls of the pump chamber. That the protuberances are disposed in at least one ring around the pump axis.

13 Claims, 3 Drawing Sheets

DELIVERY SYSTEM

BACKGROUND OF THE INVENTION

1. Field of the Invention

The invention is directed to an improved fuel delivery system for delivering fuel to an internal combustion engine of a motor vehicle.

2. Description of the Prior Art

A fuel delivery system with a pump chamber and a revolving impeller in the pump chamber rotating about a pump axis is already known from German Patent Disclosure DE 32 26 325 A1 in which protuberances are provided on predetermined end walls inside the pump chamber. The protuberances are disposed radially inward from a pump conduit provided in the end wall, and they extend away from the pump conduit in a straight line, rising in wedgelike fashion in the direction of revolution. In the rotation of the impeller in the pump chamber, the fluid backs up at the protuberances, generating a resultant force in the axial direction, pointing away from the end wall, and preventing the impeller from being able to come to rest on one of the end walls of the pump chamber. As a result, the protuberances act like a hydrodynamic bearing. Because of this, the friction acting counter to the impeller rotating in the pump chamber is reduced, and the efficiency of the fuel pump is increased. A disadvantage is that the protuberances are very complicated to produce.

OBJECT AND SUMMARY OF THE INVENTION

The delivery system of the invention has the advantage over the prior art that increasing the efficiency of the delivery system is attained in a simple way by means of reducing the friction acting on the impeller; this is done by disposing the protuberances in at least one ring around the pump axis. The protuberances space the impeller apart from the end walls of the pump chamber and are very simple and economical to produce.

Advantageous refinements of the improved delivery system of the invention are possible. It is especially advantageous if the protuberances are provided on a first end wall of an intake cap and/or on a second end wall of a pressure cap, because the protuberances on the end walls of the intake cap or the pressure cap are especially simple to make.

It is equally advantageous if the protuberances are disposed on the impeller, since the protuberances on the impeller are also very simple and economical to make.

It is highly advantageous if the height of the protuberances amounts to approximately half the difference between the axial width of the pump chamber and the axial width of the impeller, because in this way the friction acting on the impeller can be still further reduced. Moreover, a leakage flow from a higher-pressure region along the axial gap back into a lower-pressure region of the pump chamber is advantageously reduced.

In an advantageous feature, the width of the protuberances, measured in the radial direction, is about 0.8 mm. In this way, the contact area upon contact of the impeller and protuberances is small.

In another advantageous feature, the protuberances are embodied as square, rectangular, circular-annular, crescent-shaped, trapezoidal, or lenticular.

It is furthermore advantageous if the protuberances are rounded on a top side oriented toward the pump chamber, since in this way the contact area on which the impeller could come to rest is reduced.

In an advantageous exemplary embodiment, the number of protuberances disposed on a ring is in the range between 3 and 20.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
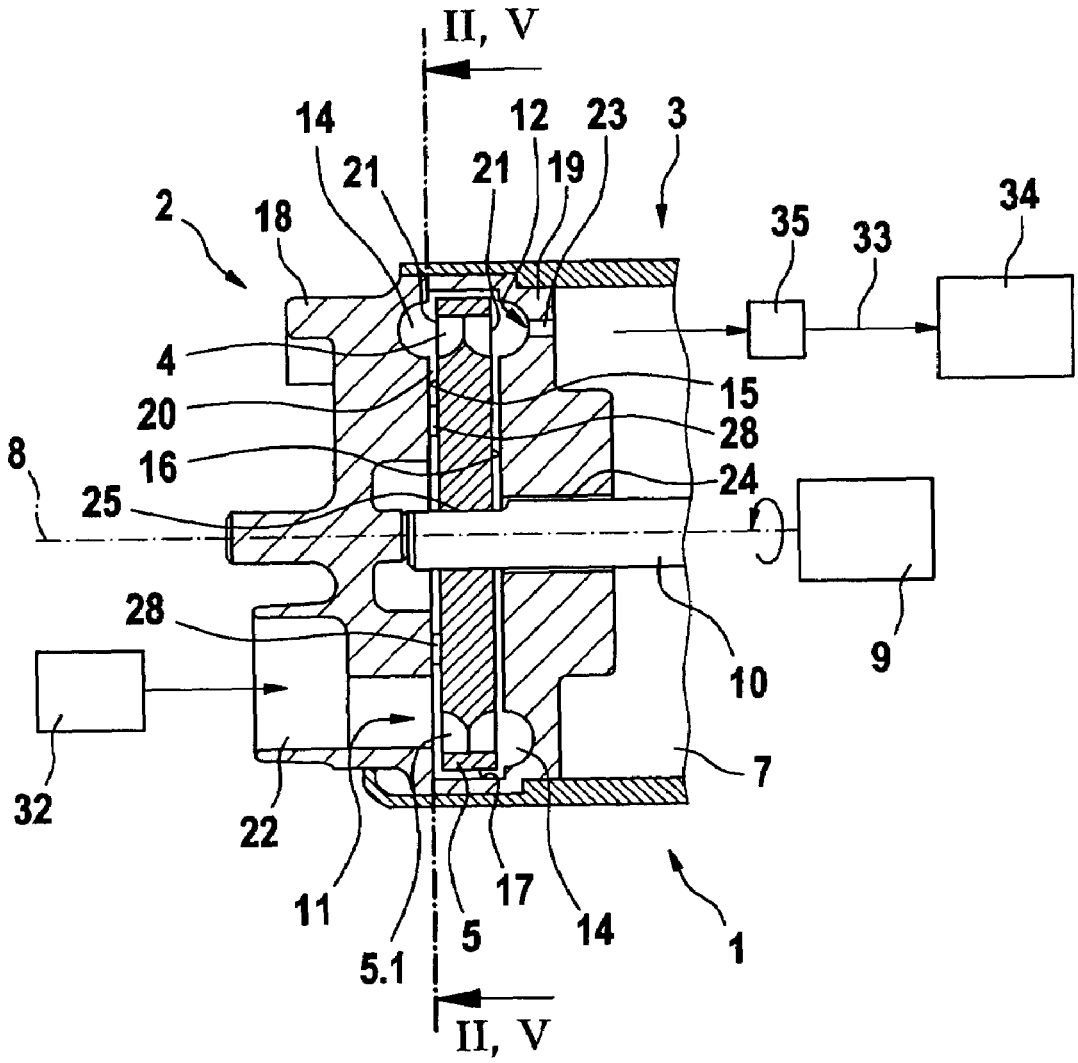
FIG. 1 in section shows a fragmentary view of the delivery system of the invention.

FIG. 1 shows a delivery system of the invention which serves to pump a fluid, such as fuel, from a supply container, for instance via a pressure line, to an internal combustion engine.

The delivery system embodied according to the invention has a pump housing 1, which has a pump part 2 and a motor part 3.

The system of the invention may be a positive displacement pump, such as a roller cell pump or geared pump, or a flow pump, such as a peripheral pump or side channel pump.

A roller cell pump is known for instance from German Patent Disclosure DE 44 37 377 A1, which is hereby expressly incorporated herein by reference. A flow pump is known for instance from German Patent Disclosure DE 44 35 883 A1, which is also hereby expressly incorporated herein by reference.

The pump part 2 has a pump chamber 4, in which an impeller 5 revolves, rotating about a rotationally symmetrical pump axis 8. The impeller 5 may be a well-known impeller of a flow pump, or a rotor that has rollers in a roller cell pump. The rollers of the roller cell pump are provided in rotor slots disposed on the circumference.

The impeller 5 is driven by an actuator 9, provided in the motor part 3, via a drive shaft 10. The actuator is an electric motor, for instance, and is disposed in a motor chamber 7 of the motor part 3.

A region upstream of the pump chamber 4 is known as the intake side, and a region downstream of the pump chamber 4 is known as the compression side of the system.

The pump chamber 4 has a pump chamber inlet 11 and a pump chamber outlet 12. The pump chamber 4 is defined by two opposed end walls in the direction of the pump axis 8, that is, a first end wall 15 and a second end wall 16, where the pump chamber inlet 11 is provided in the first end wall 15 and the pump chamber outlet 12 is provided in the second end wall 16, and is defined in the radial direction relative to the pump axis 8 by an annular wall 17.

In FIG. 1, a side channel pump is shown as an example, with an impeller 5 that has impeller blades 5.1, and with annular delivery conduits 14, which are provided in the end walls 15, 16 and are disposed in the radial region of the impeller blades 5.1.

The first end wall 15 is part of an intake cap 18, for instance, and the second end wall 16 and the annular wall 17 are for instance part of a pressure cap 19. An inlet conduit 22 is provided in the intake cap 18 and discharges into the pump chamber 4 via the pump chamber inlet 11; the pump chamber 4 communicates fluidically with the motor chamber 7 via the pump chamber outlet 12 and an outlet conduit 23 that is provided in the pressure cap 19.

The pressure cap 19 has a through opening 24. The drive shaft 10, mechanically coupled with the actuator 9, begins at the motor chamber 7 and protrudes through the through opening 24 of the pressure cap 19 into the pump chamber 4.

The axial width of the pump chamber 4 is greater than the axial width of the impeller 5, so that there is an axial gap 20 approximately ten to thirty micrometers wide between the impeller 5 and the end walls 15, 16. The difference between the width of the pump chamber 4 and the width of the impeller 5 is defined as the total axial gap.

The impeller 5 is slipped for instance onto the drive shaft 10 that protrudes into the pump chamber 4; for this purpose, the impeller 5 has an impeller opening 25, into which the drive shaft 10 at least protrudes, so as to be joined by positive and/or nonpositive engagement to the impeller. The impeller 5 is supported on the drive shaft 10 in such a way for instance that it is axially movable between the first end wall 15 and the second end wall 16.

The delivery system aspirates fluid, for instance, from a supply container 32 via the inlet conduit 22, the pump chamber inlet 11, the pump chamber 4, the pump chamber outlet 12, the outlet conduit 23, and the motor chamber 7 of the motor part of the pump housing 1, and delivers the fluid, such as fuel, to an internal combustion engine 34, for instance, via a pressure line 33. In the pressure line 33, a check valve 35 is for instance provided, so as to maintain a predetermined pressure in the pressure line 33 after the delivery system has been shut off.

Figure 2:
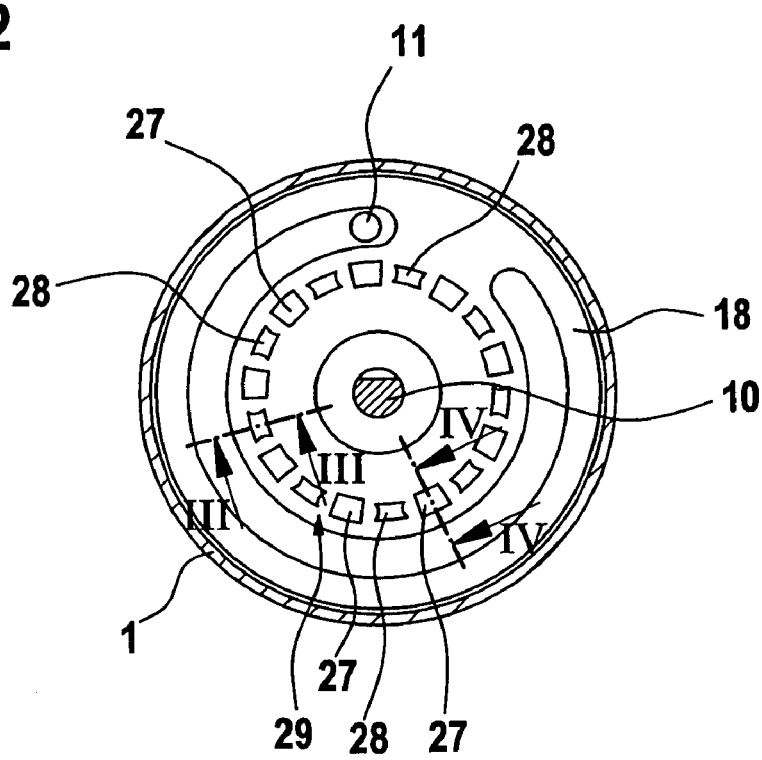
FIG. 2 is a sectional view through a first exemplary embodiment taken along the line II—II in FIG. 1.

FIG. 2 in section shows a sectional view of a first exemplary embodiment of the system of the invention taken along the line II—II in FIG. 1. In this system, those parts that remain the same or function the same as in the system of FIG. 1 are identified by the same reference numerals.

On the first end wall 15 of the intake cap 18 and/or on the second end wall 16 of the pressure cap 19, protuberances 28 are provided, which are raised relative to the main surface of the end wall 15, 16. However, the protuberances may also be disposed on one or both end faces 21 of the impeller 5 that are oriented toward the end walls 15, 16.

The radial position of the protuberances 28 can be selected arbitrarily, as long as they are not located in the radial region of the delivery conduit and/or of the blades of the impeller of a flow pump or of the slots and rollers of a roller cell pump. For instance, the protuberances 28 are located on a radius that is less than the radius of the side channel and the blades of the impeller of a side channel pump, or less than the radius of the guidance of the rollers in the rotor of a roller cell pump. The operative moments of friction at the impeller 5 are all the less, the farther radially inward the protuberances 28 are disposed.

According to the invention, the protuberances 28 are disposed in at least one imaginary ring 29 around the pump axis 8 and are spaced apart from one another circumferentially and radially. The protuberances 28 are distributed uniformly along the imaginary ring 29, for instance. The protuberances 28 are for instance square, rectangular, circular-annular, crescent-shaped, trapezoidal, oval, cylindrical, or lenticular. The cross sectional shape and the end face of the protuberances 28, however, are expressly arbitrary and may be embodied differently in the various different protuberances 28. For instance, the end face of the protuberances 28 is small compared to the end walls 15, 16 of the pump chamber 4 and to the end faces 21 of the impeller 5.

Because of the protuberances 28, there is a predetermined minimum spacing between the impeller 5 and an end wall 15, 16. In this way, the friction which is set counter to the impeller 5 by the fluid, pumped by the system, in the rotation in the pump chamber 4 is reduced. The protuberances 28 prevent the axial gap 20 between the impeller 5 and one of the end walls 15, 16 from becoming too large, as a result of axial displacement of the impeller 5 on the drive shaft 10, so that an excessively great leakage flow from a higher-pressure region along the axial gap 20 back into a lower-pressure region of the pump chamber 4 will not occur. The magnitude of the leakage flow is dependent on the cube of the width of the axial gap 20, so that the width of the axial gap 20 has very major effects on the leakage flow and hence on the efficiency of the delivery system.

By means of the protuberances 28, a considerable increase in efficiency of the pump part 2 and thus of the system can be attained, since both friction and the leakage flow are reduced.

The impeller 5 is oriented by means of the protuberances 28 such that two defined axial gaps 20 are embodied.

Preferably, a height 28.1 of the protuberances 28, measured in the axial direction, is selected such that the axial gap 20 between the impeller 5 and the first end wall 15 and the axial gap 20 between the impeller 5 and the second end wall 16 are each the same size and each amount to approximately half the total axial gap. In this way, the impeller is oriented and supported in the axial center of the pump chamber 4. However, the axial gaps 20 may expressly also be of different sizes.

The height 28.1 of the protuberances 28 is for instance about eight micrometers, but can expressly be selected arbitrarily and may also differ for different protuberances. The number of protuberances 28 disposed on a ring 29 is for instance in a range between three and twenty and is preferably seven. The width of the protuberances 28 measured in the radial direction is for instance about 0.8 mm, but can likewise be designed arbitrarily.

The protuberances 28 are disposed on a radius that is shorter than or greater than the radius on which the delivery conduit 14 is provided.

Between the individual protuberances 28, one or more recesses or grooves 27 each may be provided.

The protuberances 28 are fabricated for instance such that in a first production step, at least one annular shoulder is turned; it corresponds to the ring and is raised relative to the main surface of the end wall 15, 16. The annular shoulder 29 is interrupted in a second production step by the recesses or grooves 27, in such a way as to create a plurality of individual protuberances 28, which are spaced apart from one another, for instance uniformly, and distributed over the ring 29. Preferably, the first production step and the second production step are transposed, and the recesses or grooves are embodied for instance as crescent-shaped or circular-annular grooves 27 and distributed, for instance uniformly, over a ring 29. The sides of the protuberances 28 oriented toward the grooves 27 are for instance curved circularly inward.

In a disposition of the protuberances 28 on the end wall 15, 16 of the pump chamber 4, the recesses or grooves 27 may begin at the top 30 of the protuberances 28 and extend past the end wall 15, 16 into the intake cap 18 or the pressure cap 19, and in the case of a disposition of the protuberances 28 on the impeller 5, they can extend past the end faces 21 of the impeller 5 on into the impeller 5. In this way, the recesses or grooves 27 are embodied as indentations. As an example, one such indentation is shown in FIG. 2 between two protuberances 28; it is understood that it may also be provided between the other protuberances 28 as well.

In this way, the protuberances 28 form a crown-shaped shoulder, which can also be called a running crown, with protuberances 28 as the upward-protruding parts of the crown and indentations or recesses 27 between the protuberances 28.

It is understood that the protuberances 28 may be fabricated in some other way instead.

Figure 3:
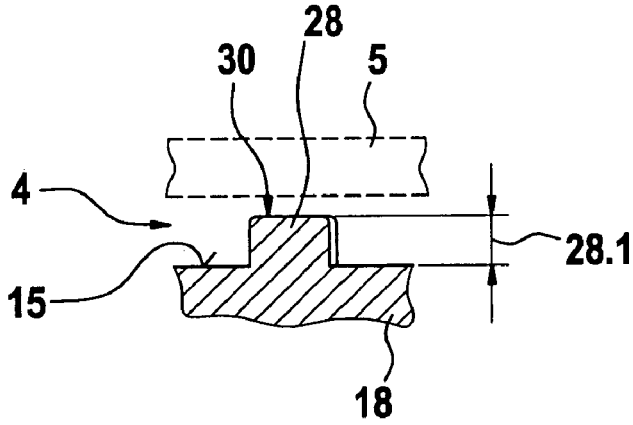
FIG. 3 is a sectional view of the first exemplary embodiment taken along the line III—III in FIG. 2.

FIG. 3 in section shows a fragmentary view of the first exemplary embodiment taken along the line III—III in FIG. 2, with an impeller shown in shaded fashion.

In the system of FIG. 3, those parts that remain the same or function the same as in the systems of FIGS. 1 and 2 are identified by the same reference numerals.

The protuberances 28 are for instance rounded on a top 30 oriented toward the pump chamber 4, in order to reduce the contact area on which the impeller 5 could come to rest.

Figure 4:
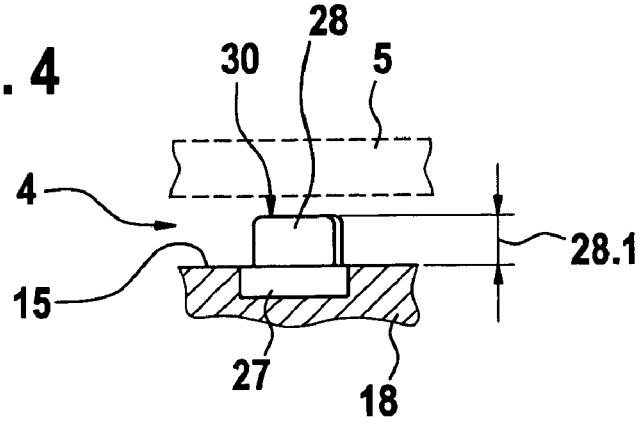
FIG. 4 is a sectional view of a second exemplary embodiment taken along the line IV—IV in FIG. 1.

FIG. 4 in section shows a fragmentary view of the first exemplary embodiment taken along the line IV—IV in FIG. 2, with an impeller shown in shaded fashion.

In the system of FIG. 4, those parts that remain the same or function the same as in the systems of FIGS. 1–3 are identified by the same reference numerals.

In this version, the recesses or grooves 27 extend for instance on into the intake cap 18. They are embodied as wider in the radial direction, for instance, than the protuberances 28.

Figure 5:
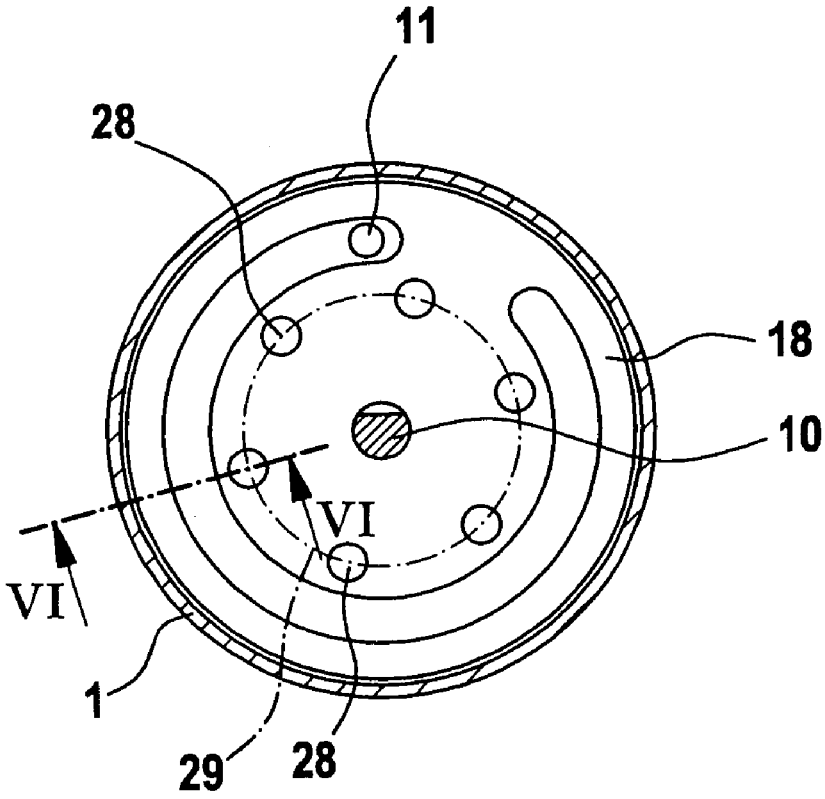
FIG. 5 is a sectional view of the second exemplary embodiment taken along the line V—V in FIG. 1.

FIG. 5 in section shows a fragmentary view of the first exemplary embodiment taken along the line V—V in FIG. 1.

In the system of FIG. 5, those parts that remain the same or function the same as in the systems of FIGS. 1–4 are identified by the same reference numerals.

The system of FIG. 5 differs from the system of FIG. 2 in the fact that the protuberances are embodied as lenticular.

The diameter of the lenticular protuberances 28 disposed on a ring 29 is arbitrary.

The lenticular protuberances 28 are molded integrally onto the end walls 15, 16 of the pump chamber 4 or onto the end faces 21 of the impeller 5, for instance, by means of injection molding.

Figure 6:
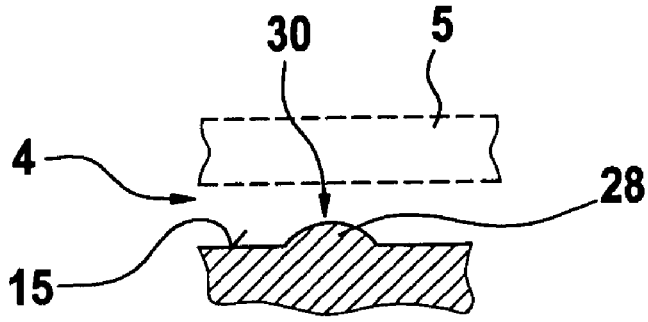
FIG. 6 is a fragmentary sectional view taken along line VI—VI of FIG. 5.

FIG. 6 in section shows a fragmentary view of the first exemplary embodiment taken along the line VI—VI in FIG. 5, with an impeller shown in shaded fashion.

In the system of FIG. 6, those parts that remain the same or function the same as in the systems of FIGS. 1–5 are identified by the same reference numerals.

The foregoing relates to preferred exemplary embodiments of the invention, it being understood that other variants and embodiments thereof are possible within the spirit and scope of the invention, the latter being defined by the appended claims.

We claim:

1. In a delivery system for delivering fuel from a fuel tank to the internal combustion engine of a motor vehicle, having a pump chamber and a revolving impeller, rotating about a pump axis in the pump chamber, in which protuberances are provided on predetermined end walls inside the pump chamber, the improvement wherein the protuberances (28) are disposed in at least one ring (29) around the pump axis (8), wherein recesses or grooves (27) embodied as indentations in said end walls are provided between the protuberances (28).

2. The system of claim 1, wherein the protuberances (28) are disposed on one or both end faces (21) of the impeller (5).

3. The system of claim 2, wherein the height of the protuberances (28) amounts to at most approximately half the difference between the axial width of the pump chamber (4) and the axial width of the impeller (5).

4. The system of claim 2, wherein the width of the protuberances (28), measured in the radial direction, is about 0.8 mm.

5. The system of claim 2, wherein the protuberances (28) are embodied as square, rectangular, circular-annular, crescent-shaped, trapezoidal, point-shaped, or lenticular.

6. The system of claim 2, wherein the protuberances (28) are rounded on a top side (30) oriented toward the pump chamber (4).

7. The system of claim 2, wherein the number of protuberances (28) disposed in a ring (29) is in the range between 3 and 20.

8. The system of claim 1, wherein that the protuberances (28) are provided on a first end wall (15) of an intake cap (18) and/or on a second end wall (16) of a pressure cap (19).

9. The system of claim 8, wherein the height of the protuberances (28) amounts to at most approximately half the difference between the axial width of the pump chamber (4) and the axial width of the impeller (5).

10. The system of claim 8, wherein the width of the protuberances (28), measured in the radial direction, is about 0.8 mm.

11. The system of claim 8, wherein the protuberances (28) are embodied as square, rectangular, circular-annular, crescent-shaped, trapezoidal, point-shaped, or lenticular.

12. The system of claim 8, wherein the protuberances (28) are rounded on a top side (30) oriented toward the pump chamber (4).

13. The system of claim 8, wherein the number of protuberances (28) disposed in a ring (29) is in the range between 3 and 20.

* * * * *